US008695139B2

(12) United States Patent
Sa

(10) Patent No.: US 8,695,139 B2
(45) Date of Patent: Apr. 15, 2014

(54) WASHING MACHINE INCLUDING A BUBBLE GENERATOR AND CONTROL METHOD THEREOF

(75) Inventor: Mi Hyun Sa, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 423 days.

(21) Appl. No.: 12/461,959

(22) Filed: Aug. 28, 2009

(65) Prior Publication Data

US 2010/0122421 A1 May 20, 2010

(30) Foreign Application Priority Data

Nov. 19, 2008 (KR) ..... 10-2008-0114942

(51) Int. Cl.
*D06F 35/00* (2006.01)
*D06F 39/08* (2006.01)

(52) U.S. Cl.
USPC ..... 8/149.1; 8/159

(58) Field of Classification Search
USPC ..... 68/149.1, 149.2, 158, 159
See application file for complete search history.

(56) References Cited

U.S. PATENT DOCUMENTS 4,118,189 A * 10/1978 Reinwald et al. ..... 8/137
5,253,380 A * 10/1993 Lim et al. ..... 8/158
5,295,373 A * 3/1994 Lim et al. ..... 68/12.05
5,307,649 A * 5/1994 Lim et al. ..... 68/12.05
5,653,129 A * 8/1997 Jang ..... 68/13 R
2004/0040344 A1* 3/2004 Minayoshi et al. ..... 68/12.16
2008/0099052 A1* 5/2008 Lee et al. ..... 134/18
2008/0251427 A1* 10/2008 Mankosa et al. ..... 209/164

FOREIGN PATENT DOCUMENTS

DE 19504806 8/1995
FR 2632329 12/1989
GB 585817 2/1947
JP 02060694 A * 3/1990 ..... D06F 17/06
JP 07-289773 11/1995
JP 11019392 A * 1/1999 ..... D06F 39/06

OTHER PUBLICATIONS

Extended European Search Report, mailed Mar. 16, 2010, in corresponding European Application No. 09169792.0 (4 pp.).

* cited by examiner

*Primary Examiner* — Joseph L Perrin
(74) *Attorney, Agent, or Firm* — Staas & Halsey LLP

(57) ABSTRACT

A washing machine, including a bubble generator, which is capable of removing a wash residue left in a drum and a water tub through the operation of the bubble generator, and a control method thereof. In the washing machine, the bubble generator is operated simultaneously with the start of drainage to create a swift current in drainage water, thereby dissolving detergent waste left in the drum and the water tub and shaking a wash residue (nap, foreign matter, etc.) such that the wash residue is discharged together with the drainage water, to surely remove the wash residue from the drum and the water tub.

9 Claims, 3 Drawing Sheets

WASHING MACHINE INCLUDING A BUBBLE GENERATOR AND CONTROL METHOD THEREOF

CROSS-REFERENCE TO RELATED APPLICATIONS

This application claims the benefit of Korean Patent Application No. 2008-0114942, filed on Nov. 19, 2008 in the Korean Intellectual Property Office, the disclosure of which is incorporated herein by reference.

BACKGROUND

1. Field

The present invention relates to a washing machine, including a bubble generator, which is capable of removing a wash residue left in a drum and a water tub through the operation of the bubble generator, and a control method thereof.

2. Description of the Related Art

Generally, a washing machine (normally, a drum type washing machine) is an apparatus, including a water tub to store water (wash water or rinse water), a cylindrical drum rotatably installed in the water tub to receive laundry, and a motor to generate a drive force necessary to rotate the drum, to remove contaminants from the laundry by surface activities of a water current and a detergent.

The washing machine performs washing through a series of operations, such as a washing operation to separate contaminants from laundry with water containing a detergent (specifically, wash water), a rinsing operation to rinse bubbles or residual detergent from the laundry with water containing no detergent (specifically, rinse water), and a spin-drying operation to spin-dry the laundry at a high speed. When washing is performed through such a series of operations, a process to drain contaminant water from the drum and the water tub is carried out after the completion of the washing operation and the rinsing operation.

The drainage process includes a stoppage drainage to drain contaminant water from the drum and the water tub while the supply of water is stopped and a water supply drainage to drain contaminant water from the drum and the water tub while the supply of water is performed. During the drainage (the stoppage drainage or the water supply drainage), a wash residue (specifically, foreign matter such as detergent waste or nap) generated during the washing operation or the rinsing operation is discharged together with contaminated water (drainage water).

During the drainage process, most of the wash residue is discharged together with the drainage water. However, some of the wash residue is not discharged but is left in the drum or between the drum and the water tub. For example, during the stoppage drainage, only the drainage water is drained while the wash residue stays or settles, with the result that the wash residue is left in the drum and the water tub. On the other hand, during the water supply drainage, the wash residue between the drum and the water tub is discharged to some extent by supplied water, but the wash residue at the bottom of the water tub and in the drum is not easily discharged, with the result that the wash residue is left in the drum and the water tub as in the stoppage drainage. When the wash residue (specifically, detergent waste) is continuously left, bubbles are continuously generated during a subsequent rinsing operation, which brings about dissatisfaction of users with the product. Also, laundry may be contaminated again by the contamination of the drum and the water tub, which lowers rising efficiency.

SUMMARY

Therefore, it is an aspect of one or more embodiments to provide a washing machine, including a bubble generator, which is capable of creating a swift current in drainage water, during drainage, by operating the bubble generator to discharge a wash residue left in a drum and a water tub together with the drainage water and a control method thereof.

The foregoing and/or other aspects are achieved by providing, a control method of a washing machine, including determining whether a drainage process has started, operating a bubble generator to create a swift current upon determining that the drainage process has started, and removing a wash residue from the washing machine using the swift current.

The operation of the bubble generator may be performed before the drainage or during the drainage.

The operating the bubble generator to create the swift current may include causing water between a drum and a water tub to flow by the operation of the bubble generator.

The removing the wash residue may include dissolving a detergent left in the drum and the water tub, and floating the wash residue, by the swift current to discharge the wash residue together with the water between the drum and the water tub.

The control method may further include determining whether the drainage process is post-washing drainage and on/off operating the bubble generator upon determining that the drainage is post-washing drainage.

The control method may further include determining whether the drainage process is post-rinsing drainage, and continuously operating the bubble generator upon determining that the drainage is post-rinsing drainage.

The control method may further include sensing a change of a water level according to the drainage, and stopping the bubble generator upon the water level reaching a predetermined water level.

The foregoing and/or other aspects are achieved by providing, a washing machine including a water tub to receive water, a drum installed in the water tub, a bubble generator to cause the water to flow and to create a swift current, and a controller to control the bubble generator, during drainage, removing a wash residue left in the drum and the water tub.

The bubble generator may also be used to wash laundry during a washing process.

The washing machine may further include a drainage unit, and the controller may control the drainage unit to discharge the wash residue.

The controller may control the bubble generator to be operated before the controlling of the drainage unit or during the controlling of the drainage unit.

The controller may determine whether the drainage is post-washing drainage and may control the bubble generator to be on/off operated upon determining that the drainage is post-washing drainage.

The controller may determine whether the drainage is drainage after the completion of rinsing, and may control the bubble generator to be continuously operated upon determining that the drainage is post-rinsing drainage.

The washing machine may further include a water level sensing unit to sense a water level of the water tub, and the controller may control the bubble generator to be stopped upon the water level reaching a predetermined water level.

The foregoing and/or other aspects are achieved by providing a control method of a washing machine including determining that a washing or a rinsing process has completed, operating a bubble generator to create a swift current upon determining that the washing or the rinsing process has completed, and performing drainage while or after operating a bubble generator.

The operating the bubble generator to create the swift current may include causing water between a drum and a water tub to flow rapidly by the operation of the bubble generator.

The control method may further include determining whether the process that has completed is the washing or the rinsing process, and on/off operating the bubble generator upon determining that the completed process is the washing process.

The control method may further include determining whether the process that has completed is the washing or the rinsing process, and continuously operating the bubble generator upon determining that the completed process is the rinsing process.

The control method may further include sensing a change of a water level according to the drainage, and stopping the bubble generator when the water level reaches a predetermined water level.

The control method may further include performing spin-drying after the bubble generator is stopped.

The operating of the bubble generator may depend upon an amount of load.

The operating of the bubble generator may be simultaneous with a start of the drainage.

The operating the bubble generator may include pumping air into a porous material box, creating bubbles in drainage water by dispersing the air pumped into the porous material box into a space between a water tub and a drum, and allowing bubbles to combine to create the swift current.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
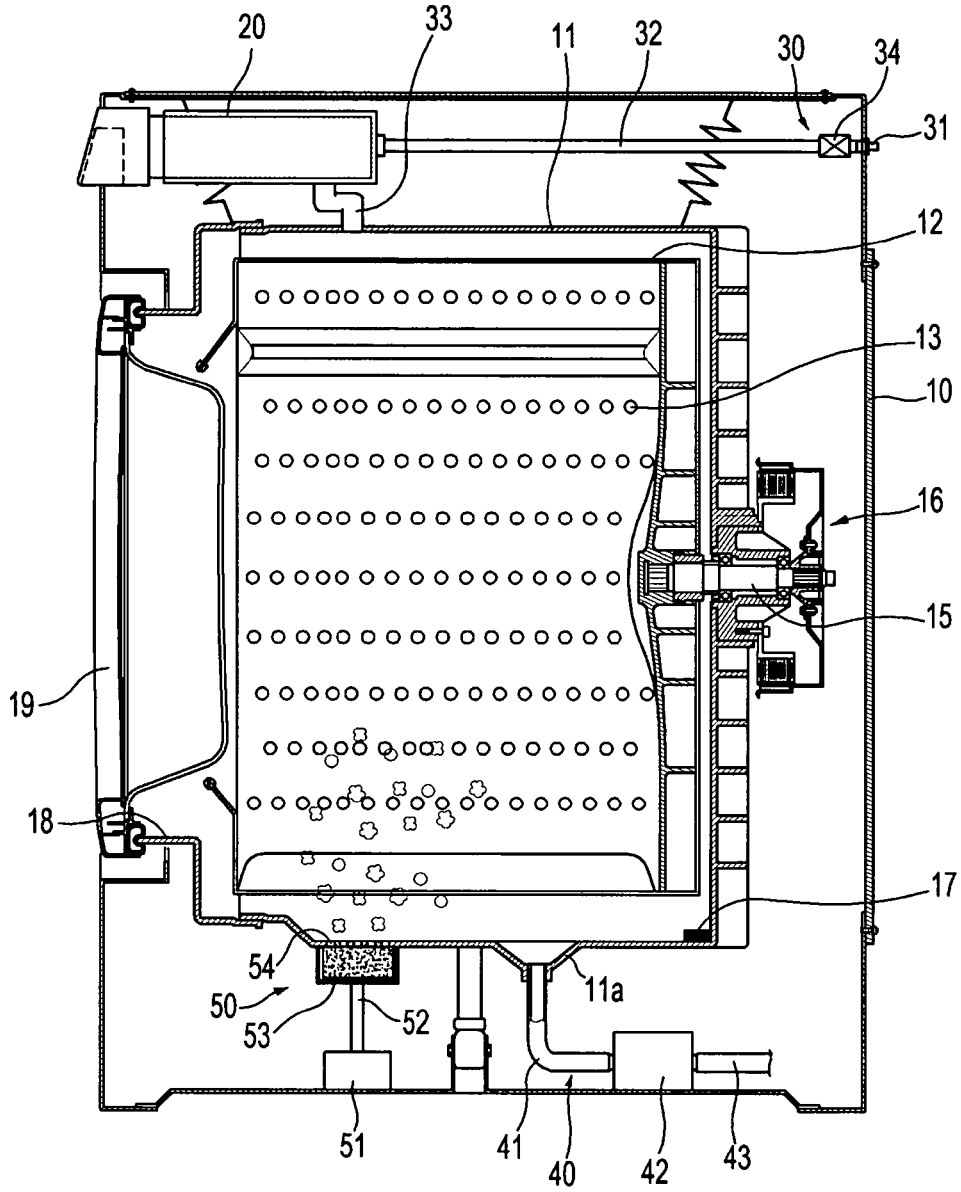
FIG. 1 is a sectional view illustrating the structure of a washing machine according to an embodiment.

Reference will now be made in detail to the embodiments, examples of which are illustrated in the accompanying drawings, wherein like reference numerals refer to the like elements throughout. The embodiments are described below to explain the present invention by referring to the figures.

FIG. 1 is a sectional view illustrating the structure of a washing machine according to an embodiment.

Referring to FIG. 1, the washing machine includes a drum-type water tub 11 installed in a machine body 10 to store water (wash water or rinse water) and a cylindrical drum 12 rotatably installed in the water tub 11. The drum 12 has a plurality of spin-drying holes 13.

Outside the rear of the water tub 11 is installed a drive unit, i.e., a motor 16, to rotate a rotary shaft 15 connected to the drum 12 such that washing, rinsing, and spin-drying operations are performed in the drum 12. Inside the bottom of the water tub is installed a water level sensing unit, i.e., a water level sensor 17, to sense a frequency which changes depending upon a water level to sense the amount (water level) of water in the water tub 11.

At the front of the machine body 10 is installed a door 19 having an inlet port 18 through which laundry is put into the drum 12 or laundry is removed from the drum 12.

Above the water tub 11 are installed a detergent supply unit 20 to supply a detergent and a water supply unit 30 to supply water (wash water or rinse water).

The detergent supply unit 20 is partitioned into several spaces. The detergent supply unit 20 is installed at the front of the machine body 10 such that a user can easily put a detergent and a softener in the respective spaces.

The water supply unit 30 includes a first water supply pipe 32 connected between an external water supply pipe 31 and the detergent supply unit 20, a second water supply pipe 33 connected between the detergent supply unit 20 and the water tub 11, and a water supply valve 34 installed on the first water supply pipe 32 to control the supply of water, to supply water (wash water or rinse water) into the water tub 1. In this structure, water passes through the detergent supply unit 20, before the water is supplied into the water tub 11, such that the detergent in the detergent supply unit 20 is supplied into the water tub 11 together with the water.

Also, the washing machine further includes a drainage unit 40 to drain contaminated water in the water tub 11, i.e., drainage water. The drainage unit 40 includes a first drainage pipe 41 connected to a drainage port 11*a* formed at the bottom of the water tub 11, a drainage pump 42 installed on the first drainage pipe 41, and a second drainage pipe 43 connected to the outlet side of the drainage pump 42, to drain the drainage water to the outside.

Also, the washing machine further includes a bubble generator 50 to generate bubbles such that laundry in the drum 12 is washed by the bubbles. The bubble generator 50 includes an air pump 51 installed below the water tub 11 to supply air, an air supply pipe 52 to convey air supplied from the air pump 51, and a porous material box 53 installed at the end of the air supply pipe 52. The porous material box 53 contains a porous material to disperse the supply air.

The porous material box 53 has an open top in tight contact with the bottom of the water tub 11. At the bottom of the water tub 11 contacting the open top of the porous material box 53 are formed a plurality of air holes 54 through which air flows. Consequently, air, supplied from the air pump 51, flows through the air supply pipe 52 and passes through the porous material box 53 where the air is dispersed. The dispersed air is introduced into a space defined between the water tub 11 and the drum 12 to generate bubbles from the water such that laundry in the drum 12 is washed by the generated bubbles.

Also, the washing machine creates a swift current in drainage water, during drainage, by operating the bubble generator 50, such that a wash residue left in the drum 12 and the water tub 11, i.e., a wash residue (specifically, foreign matter such as detergent waste or nap) left in the drum 12 (specifically, inside the drum 12) or between the drum 12 and the water tub 11 (specifically, outside the drum 12 or inside the water tub 11) is discharged together with the drainage water by the swift current, to remove the wash residue from the drum 12 and the water tub 11.

Figure 2:
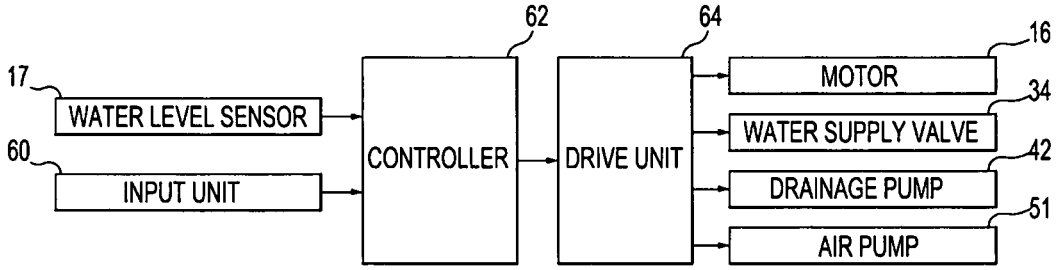
FIG. 2 is a control block diagram of the washing machine according to an embodiment.

FIG. 2 is a control block diagram of the washing machine according to the embodiment. The washing machine further includes an input unit 60, a controller 62, and a drive unit 64.

The input unit 60 allows a user to input operation information, a washing course (for example, normal washing or bubble washing), spin-drying RPM, and the addition of rinsing, to the controller 62. The water level sensor 17 may provide water level data to the controller 62.

The controller 62 is a microprocessor to control the whole operation of the washing machine, such as washing, rinsing, and spin-drying, the washing machine according to the operation information inputted from the input unit 60. The controller 62 stores motor RPM and bubble generating operation rate (air pump on-off time), and washing time set depending upon the amount of load (the weight of laundry) in the selected washing course.

Consequently, the controller 62 controls the motor RPM and the bubble generating operation rate depending upon the amount of load, during bubble washing, thereby controlling the operation of the motor 16 and the air pump 51 to effectively achieve a washing operation.

Referring to FIGS. 1 and 2, also, the controller 62 controls the bubble generator 50 to be operated simultaneously with the start of drainage at a drainage process, which is carried out after the completion of a washing operation or a rinsing operation, thereby controlling the operation of the drainage pump 42 and the air pump 51 such that a wash residue left in the drum 12 and the water tub 11, among a wash residue generated during the washing operation or the rinsing operation, is discharged together with drainage water by a swift current created by the bubble generator 50.

The drive unit 64 drives the motor 16, the water supply valve 34, the drainage pump 42, and the air pump 51 according to a drive control signal of the controller 62.

Hereinafter, the operation of the washing machine with the above-stated construction and a control method thereof will be described.

Figure 3:
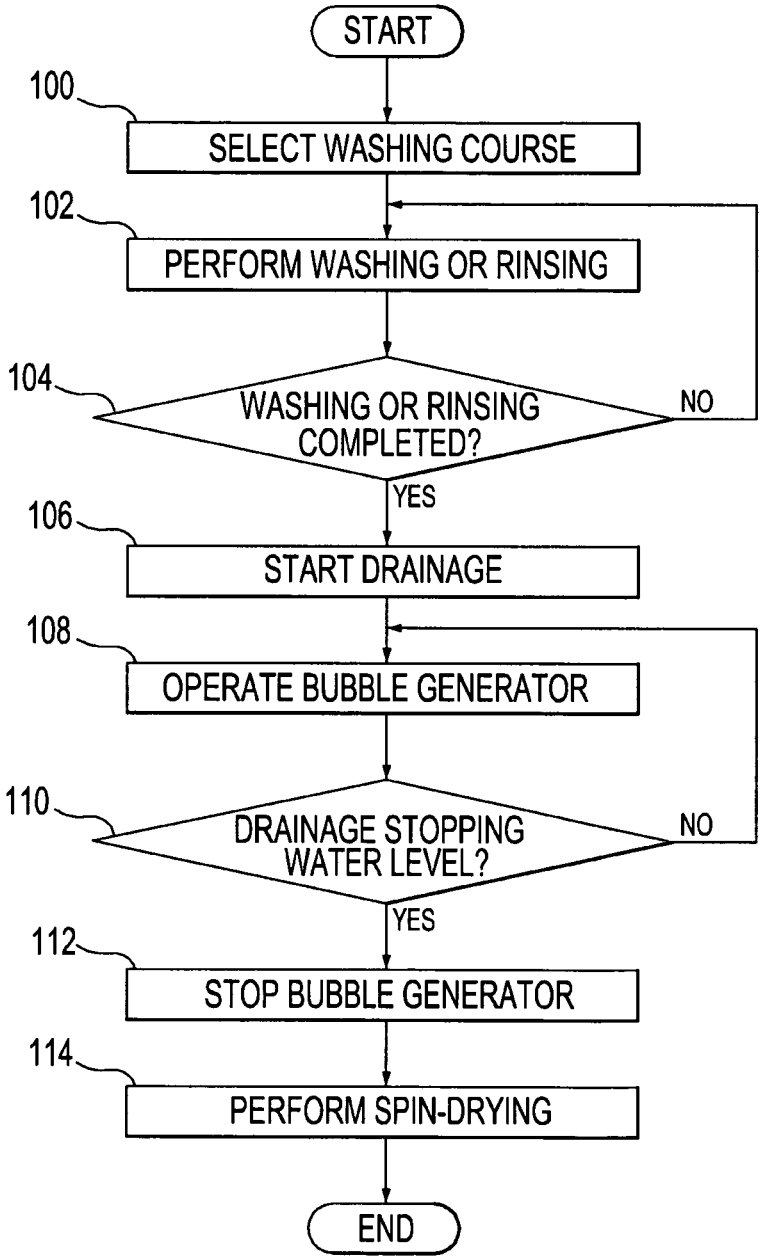
FIG. 3 is a flow chart illustrating a drainage control process of the washing machine according to an embodiment.

FIG. 3 is a flow chart illustrating a drainage control process of the washing machine according to an embodiment, i.e., an algorithm to remove a wash residue left in the drum 12 or the water tub 11 in performing a drainage process after the completion of a washing operation or a rinsing operation.

Referring to FIGS. 1, 2 and 3, when a user puts laundry in the drum 12 and, as in operation 100, selects operation information, such as a washing course, spin-drying RPM, and the addition of rinsing, according to the kind of laundry, the operation information selected by the user is inputted to the controller 62 through the input unit 60.

Consequently, the controller 62 controls a washing operation or a rinsing operation 102 to be carried out according to the operation information inputted from the input unit 60.

A process to perform the washing operation in which water and a detergent are supplied, and the motor 16 and the bubble generator 50 are operated, or a process to perform the rinsing operation in which water is supplied, and the motor 16 is operated is a general process performed in the washing machine including the bubble generator 50, and therefore, a detailed description thereof will not be given.

Subsequently, the controller 62 determines whether the washing operation or the rinsing operation has been completed in operation 104. When it is determined that the washing operation or the rinsing operation has been completed, the controller 62 controls the drainage pump 42 to be operated to start a drainage process in operation 106, in which contaminated water in the drum 12 and the water tub, generated during the washing operation or the rinsing operation, i.e., drainage water, is discharged to the outside through the first and second drainage pipes 41 and 43.

In operation 108, the controller 62 controls the bubble generator 50 to be operated simultaneously with the start of the drainage process, such that a swift current is created in the drainage water, to dissolve detergent waste left in the drum 12 and the water tub 11 and to float a wash residue (nap, foreign matter, etc.), such that the wash residue, left in the drum 12 and the water tub 11, is discharged together with the drainage water.

The swift current is created as follows. According to the operation of the air pump 51, air is introduced into the porous material box 53 through the air supply pipe 52. The air is dispersed in the porous material box 53 and is then introduced into a space defined between the water tub 11 and the drum 12 through the air holes 54. As a result, bubbles are generated in the drainage water, thereby creating the swift current in the drainage water.

In one or more embodiments, the swift current is created using the porous material box 53, however, any structure that is capable of creating the swift current may be used.

When the wash residue, left in the drum 12 and the water tub 11, is discharged together with the drainage water, no bubbles are generated during a subsequent rinsing operation, and therefore, a rinsing effect is improved. Furthermore, little wash residue is left in the drum 12 and the water tub 11, even after using the washing machine for a long time, and therefore, it is not necessary to perform an additional tub washing course. Even when the tub washing course is necessary, it is possible to extend a tub washing cycle.

In one or more embodiments, the operation of the bubble generator 50 is controlled differently after the completion of the washing operation and after the completion of the rinsing operation. For example, in a drainage process carried out after the completion of the washing operation, the bubble generator 50 is operated with an on/off operation rate of 1:1. In a drainage process carried out after the completion of the rinsing operation, the bubble generator 50 is controlled to be continuously operated. This is because, after the completion of the washing operation, a large amount of detergent bubbles exist in the drum 12 and the water tub 11 due to the bubble washing, and therefore, when the bubble generator 50 is continuously operated in this state, the drum 12 and the water tub 11 are filled with a much more amount of bubbles than the effect of creating a swift current in the drainage water, and therefore, drainage time lengthens, with the result that a drainage error may occur. For this reason, the bubble generator 50 is on/off operated such that the detergent bubbles existing after the completion of the washing operation sink to the bottom of the water tub 11.

The process to create the swift current in the drainage water by the bubble generator 50 is continued, until the water level of the drainage water left in the water tub 11 reaches a predetermined drainage stopping water level (water level at which the drainage process is stopped), to surely remove the wash residue from the drum 12 and the water tub 11.

Consequently, the controller 62 senses the water level of the drainage water lowering by the drainage process through the water level sensor 17 to determine in operation 110, whether the water level of the drainage water has reached the drainage stopping water level (110).

Upon determining in operation 110 that the water level of the drainage water has not reached the drainage stopping water level, the controller 62 controls the bubble generator 50 to be operated to create a swift current in the drainage water, until the water level of the drainage water reaches the drainage stopping water level, such that the wash residue, left in the drum 12 and the water tub 11, is discharged together with the drainage water.

Upon determining in operation 110 that the water level of the drainage water has reached the drainage stopping water level, the controller 62 controls the bubble generator 50 to be stopped in operation 112, and controls spin-drying to be performed in operation 114.

In an embodiment, the stoppage drainage in which the supply of water is stopped during the operation of the bubble generator 50 simultaneously with the start of the drainage process was illustrated and explained as an example. However, alternatively, a water supply drainage in which the supply of water is performed during the operation of the bubble generator 50 simultaneously with the start of the drainage process may be performed to achieve the same purpose and similar effect as the stoppage drainage.

As apparent from the above description, in the washing machine including the bubble generator 50 according to one or more embodiments, the bubble generator 50 is operated simultaneously with the start of drainage to create a swift current in drainage water, thereby dissolving detergent waste left in the drum and the water tub and shaking a wash residue (nap, foreign matter, etc.) such that the wash residue is discharged together with the drainage water, to surely remove the wash residue from the drum and the water tub.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A control method of a washing machine having a water tub and a rotary drum rotatably mounted therein to receive laundry, comprising:

performing a washing operation to wash the laundry in the rotary drum with bubbles generated by a first bubble generation operation;

performing a first drainage operation after the washing operation to remove water and wash residue from the washing machine; and performing a second bubble generation operation during the first drainage operation to introduce bubbles in the water tub and the rotary drum, wherein performing the second bubble generation operation comprises cycling a bubble generator on and off during the drainage operation, the bubble generator being cycled on and off more than one time during the drainage operation, and wherein the bubbles generated during the second bubble generation operation cause wash residue to float so that wash residue can be discharged together with water during the drainage operation.

2. The control method according to claim 1, wherein the performing of the second bubble generation operation comprises operating the bubble generator to create a swift current so as to cause water between the rotary drum and the water tub to flow by the operating of the bubble generator.

3. The control method according to claim 1, wherein the removing the wash residue comprises dissolving a detergent left in a drum and a water tub, and floating the wash residue by a swift current to discharge the wash residue together with water between the drum and the water tub.

4. The control method according to claim 1, further comprising:

performing a rinsing operation after the washing operation;

performing a second drainage operation after the rinsing operation; and performing a third bubble generation operation during the second drainage operation;

wherein performing the third bubble generation operation comprises continuously operating the bubble generator.

5. The control method according to claim 1, further comprising:

sensing a change of a water level according to the drainage operation; and stopping the bubble generator upon the water level reaching a predetermined water level. allowing bubbles to combine to create the swift current.

6. The control method according to claim 1, wherein the bubbles generated during the second bubble generation operation serve to reduce an amount of wash residue remaining in the washing machine at a completion of the drainage operation.

7. The control method according to claim 1, wherein the first bubble generation operation and the second bubble generation operation are performed using the bubble generator.

8. The control method according to claim 7, wherein the bubble generator comprises an air pump.

9. The control method according to claim 1, further comprising:

performing a rinsing operation after the washing operation, wherein a third bubble generation operation is performed after the rinsing operation and before the first drainage operation.

* * * * *

UNITED STATES PATENT AND TRADEMARK OFFICE

CERTIFICATE OF CORRECTION

PATENT NO. : 8,695,139 B2
APPLICATION NO. : 12/461959
DATED : April 15, 2014
INVENTOR(S) : Sa It is certified that error appears in the above-identified patent and that said Letters Patent is hereby corrected as shown below:

In the Claims

Column 8, Lines 29-30, in Claim 5, delete "level. allowing bubbles to combine to create the swift current." and insert -- levels. --, therefor.

Signed and Sealed this
Twenty-second Day of July, 2014

Michelle K. Lee

Michelle K. Lee
*Deputy Director of the United States Patent and Trademark Office*